US008430474B2

(12) United States Patent
Ciminelli et al.

(10) Patent No.: US 8,430,474 B2
(45) Date of Patent: Apr. 30, 2013

(54) DIE MOUNTING ASSEMBLY FORMED OF DISSIMILAR MATERIALS

(75) Inventors: Mario J. Ciminelli, Rochester, NY (US); Dwight J. Petruchik, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 358 days.

(21) Appl. No.: 12/797,850

(22) Filed: Jun. 10, 2010

(65) Prior Publication Data

US 2011/0304673 A1 Dec. 15, 2011

(51) Int. Cl.
*B41J 2/015* (2006.01)

(52) U.S. Cl.
USPC ..... 347/20

(58) Field of Classification Search ..... None
See application file for complete search history.

(56) References Cited

U.S. PATENT DOCUMENTS

| | | | | |
|---|---|---|---|---|
| 2003/0227516 | A1 | 12/2003 | Yamaguchi et al. | |
| 2008/0149024 | A1 | 6/2008 | Petruchik et al. | |
| 2008/0174636 | A1* | 7/2008 | Kim et al. | 347/47 |
| 2010/0079542 | A1 | 4/2010 | Ciminelli et al. | |

FOREIGN PATENT DOCUMENTS

| | | |
|---|---|---|
| EP | 1 078 759 | 2/2001 |
| EP | 1 946 930 | 7/2008 |

* cited by examiner

*Primary Examiner* — Matthew Luu
*Assistant Examiner* — Renee I Wilson
(74) *Attorney, Agent, or Firm* — Peyton C. Watkins

(57) ABSTRACT

A mounting assembly for a microelectronic device, the mounting assembly includes (a) a first member formed of a first material having a first coefficient of thermal expansion, the first member including i) a mounting surface for the microelectronic device; ii) a wall that adjoins the mounting surface and that is recessed from the mounting surface; and iii) an extension of the mounting surface that extends beyond an end of the wall; and (b) a second member formed of a plastic material having a second coefficient of thermal expansion that is larger than the first coefficient of thermal expansion, wherein a first portion of the second member is attached to the extension.

19 Claims, 14 Drawing Sheets

DIE MOUNTING ASSEMBLY FORMED OF DISSIMILAR MATERIALS

FIELD OF THE INVENTION

The present invention relates generally to a die mounting assembly formed of dissimilar materials, and more particularly to a feature designed to reduce thermal stress on encapsulant by keeping encapsulant material from bridging between two regions having different coefficients of thermal expansion.

BACKGROUND OF THE INVENTION

Microelectronic packaging of electronic devices typically includes a die, a mounting substrate, electrical interconnections and an encapsulant to protect the electrical interconnections. Electronic devices having special requirements, such as alignment, heat dissipation, fluidic connection, impact shielding, and etc. can also impose corresponding additional requirements for the microelectronic packaging of the device. In some cases, such requirements can be solved using a mounting substrate formed of dissimilar materials. For example, US Patent Application Publication 2008/0149024, incorporated by reference herein in its entirety, describes a mounting substrate for an inkjet printhead die where a mounting assembly is made by insert molding. The mounting assembly includes a die mounting substrate for the mounting of the printhead die, a support region that provides alignment features, and a support for a flex circuit. In the insert molding process, the die mounting substrate (formed of ceramic, for example) can be placed in an injection molding tool and then molded plastic is formed around the die mounting substrate. Such a printhead die mounting assembly is an example of a die mounting assembly formed of dissimilar materials.

While the examples described herein will relate to inkjet printheads, it is contemplated that die mounting assemblies formed of dissimilar materials are not restricted to inkjet printheads. In particular, it is contemplated that electrical interconnections can be located in a region of a die mounting assembly near the boundary between two materials having different thermal expansion coefficients. As a result, the encapsulant that is deposited over the electrical interconnections can inadvertently bridge across the boundary between the two materials. Subsequent heating and/or cooling cycles (including cooling after the curing of the encapsulant at elevated temperature) can cause the encapsulant to crack. Such cracks can compromise the environmental protection provided by the encapsulant and therefore impair the reliability of the assembled device.

What is needed is a die mounting assembly that improves the reliability of the assembled device by keeping encapsulant from inadvertently bridging between two regions having different coefficients of thermal expansion.

SUMMARY OF THE INVENTION

The present invention is directed to overcoming one or more of the problems set forth above. Briefly summarized, according to one aspect of the invention, the invention resides in a mounting assembly for a microelectronic device, the mounting assembly comprising a first member formed of a first material having a first coefficient of thermal expansion, the first member including: a) a mounting surface for the microelectronic device; b) a wall that adjoins the mounting surface and that is recessed from the mounting surface; and c) an extension of the mounting surface that extends beyond an end of the wall; and a second member formed of a plastic material having a second coefficient of thermal expansion that is larger than the first coefficient of thermal expansion, wherein a first portion of the second member is attached to the extension.

DETAILED DESCRIPTION OF THE INVENTION

Figure 1:
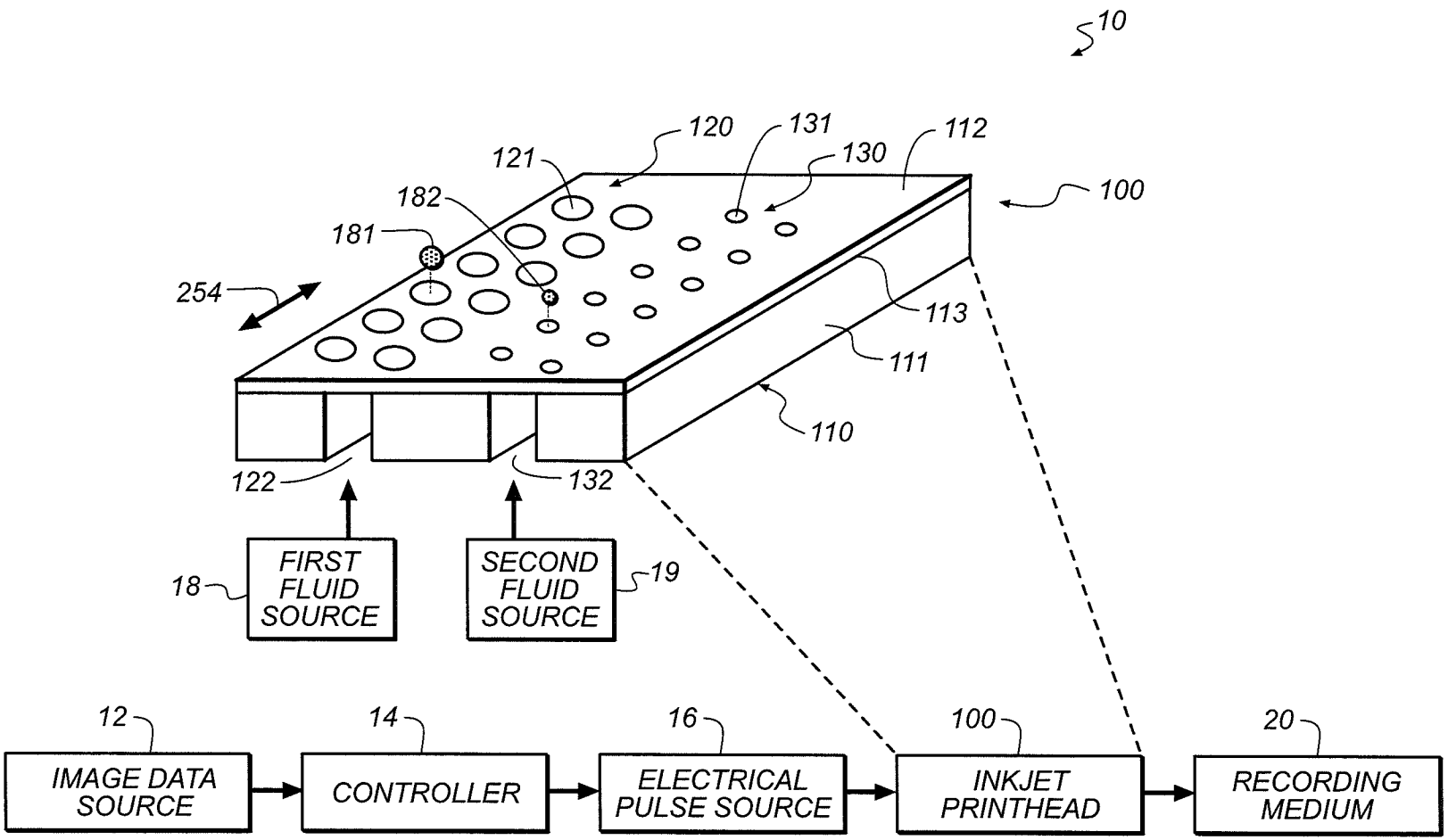
FIG. 1 schematically shows an inkjet printer system.

Referring to FIG. 1, a schematic representation of an inkjet printer system 10 is shown, as described in U.S. Pat. No. 7,350,902 and is incorporated by reference herein in its entirety. Inkjet printer system 10 includes an image data source 12 which provides signals that are interpreted by a controller 14 as being commands to eject drops. Controller 14 outputs signals to a source 16 of electrical energy pulses that are inputted to the inkjet printhead 100 which includes at least one printhead die 110.

In the example shown in FIG. 1, there are two nozzle arrays provided on a nozzle face (or nozzle plate) 112 formed on substrate 111 of printhead die 110, which is a microelectronic device. Nozzles 121 in the first nozzle array 120 have a larger opening area than nozzles 131 in the second nozzle array 130. Nozzle arrays 120 and 130 extend along array direction 254. In this example, each of the two nozzle arrays has two staggered rows of nozzles, each row having a nozzle density of 600 per inch. The effective nozzle density then in each array is 1200 per inch. If pixels on the recording medium were sequentially numbered along the paper advance direction, the nozzles from one row of an array would print the odd numbered pixels, while the nozzles from the other row of the array would print the even numbered pixels.

Nozzle plate 112 includes an edge at or near die edge 113 where nozzle plate 112 adjoins die substrate 111 on the edge of printhead die 110 that is substantially parallel to array direction 254. As described below, edge 113 moves past opposite side edges of the recording medium 20 during printing.

In fluid communication with each nozzle array is a corresponding ink delivery pathway. Ink delivery pathway 122 is in fluid communication with first nozzle array 120, and ink delivery pathway 132 is in fluid communication with second nozzle array 130. Portions of fluid delivery pathways 122 and 132 are shown in FIG. 1 as openings through printhead die substrate 111.

One or more printhead die 110 will be included in inkjet printhead 100, but only one printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1 are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
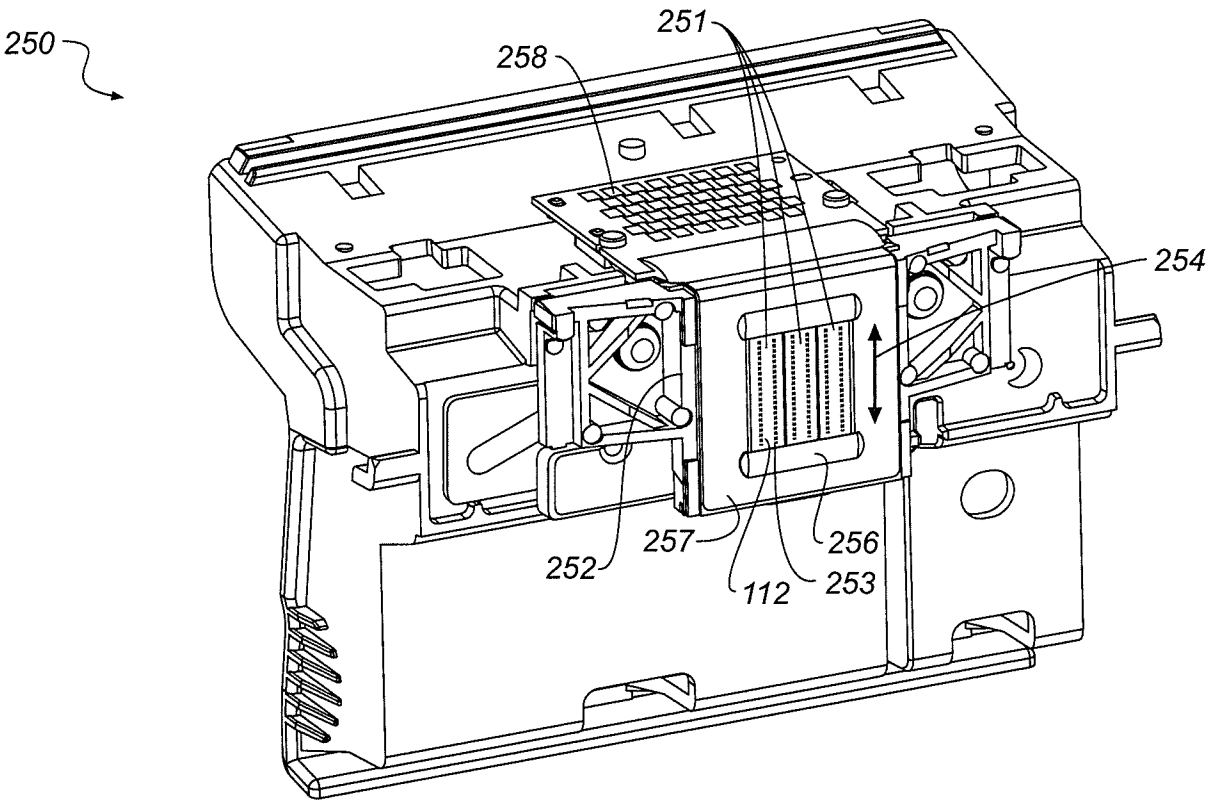
FIG. 2 shows a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253 formed on a nozzle face 112, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid.

The three printhead die 251 are mounted on mounting substrate 252 such that each of the six nozzle arrays 253 is disposed along array direction 254. The length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium. Following the printing of a swath, the recording medium is advanced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
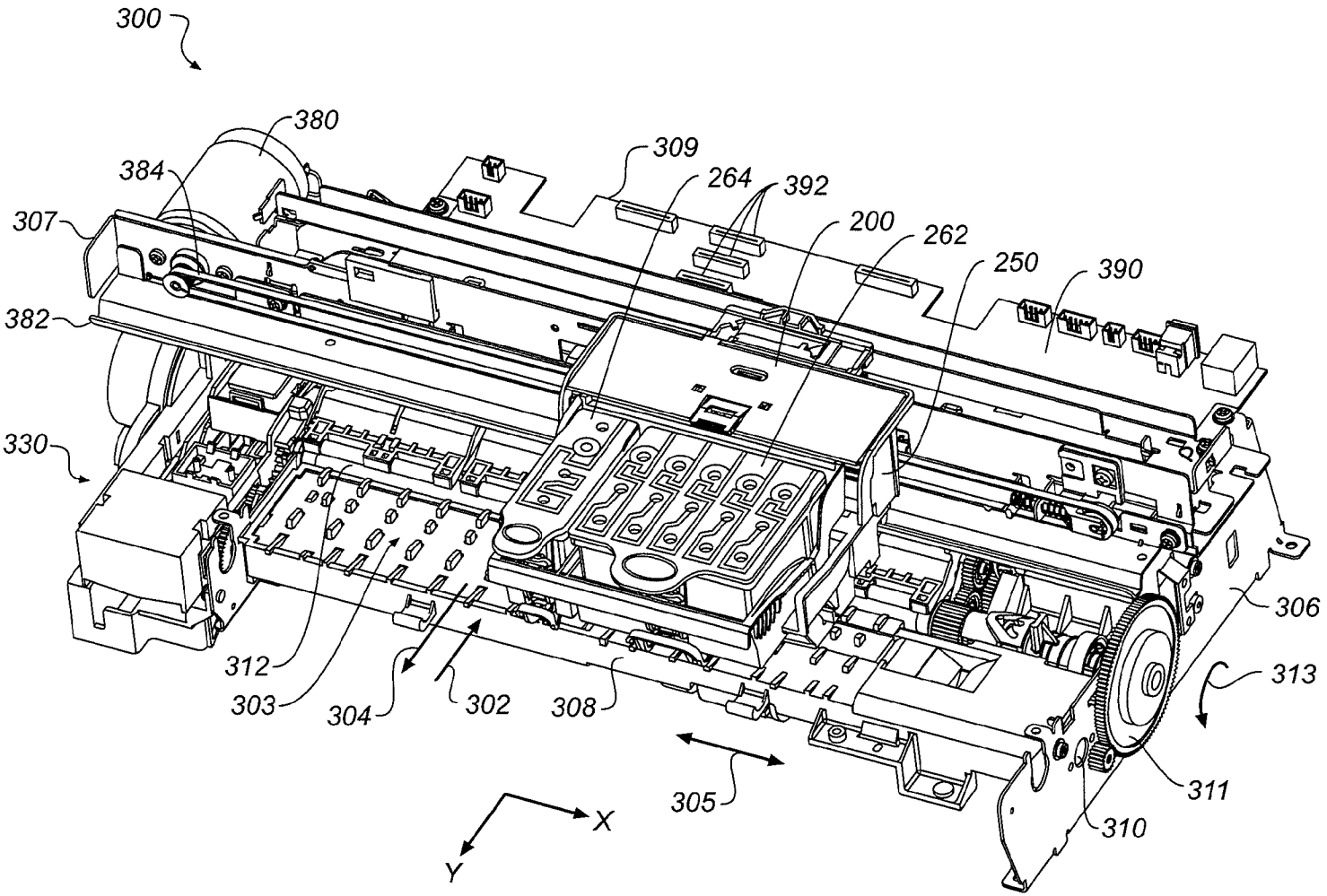
FIG. 3 is a perspective view of a portion of a carriage printer.

FIG. 3 shows a portion of a carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis between the right side 306 and the left side 307 of printer chassis 300 while printing by ejecting drops from printhead die 251 mounted on printhead chassis 250 (see FIG. 2). Carriage motor 380 moves belt 384 to move carriage 200 back and forth along carriage guide rail 382. Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording media in print region 303 in the view of FIG. 3. Ink supply 262, in this example, contains five ink sources cyan, magenta, yellow, photo black, and colorless protective fluid, while ink supply 264 contains the ink source for text black.

Paper or other recording media (sometimes generically referred to as paper herein) is loaded along paper load entry direction 302 toward the front 308 of printer chassis 300. A variety of rollers are used to advance the medium through the printer, as shown schematically in the side view of FIG. 4. In this example, a pickup roller 320 moves the top sheet 371 of a stack 370 of paper or other recording media in the direction of arrow 302. A turn roller 322 toward the rear 309 of the printer chassis 300 acts to move the paper around a C-shaped path (in cooperation with a curved rear wall surface) so that the paper continues to advance along direction arrow 304 from the rear 309 of the printer. The paper is then moved by feed roller 312 and idler roller(s) 323 to advance along the Y axis across print region 303, and from there to a discharge roller 324 and star wheel(s) 325 so that printed paper exits along direction 304. Feed roller 312 includes a feed roller shaft along its axis, and feed roller gear 311 is mounted on the feed roller shaft. Feed roller 312 may consist of a separate roller mounted on feed roller shaft, or may consist of a thin high friction coating on feed roller shaft. The motor that powers the paper advance rollers is not shown in FIG. 3, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example of FIG. 3 is the maintenance station 330. Maintenance station 330 includes wipers (not shown) for wiping the nozzle face of the printhead as well as a cap (not shown) to seal around the nozzle face region when the printhead is not in use.

Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Figure 4:
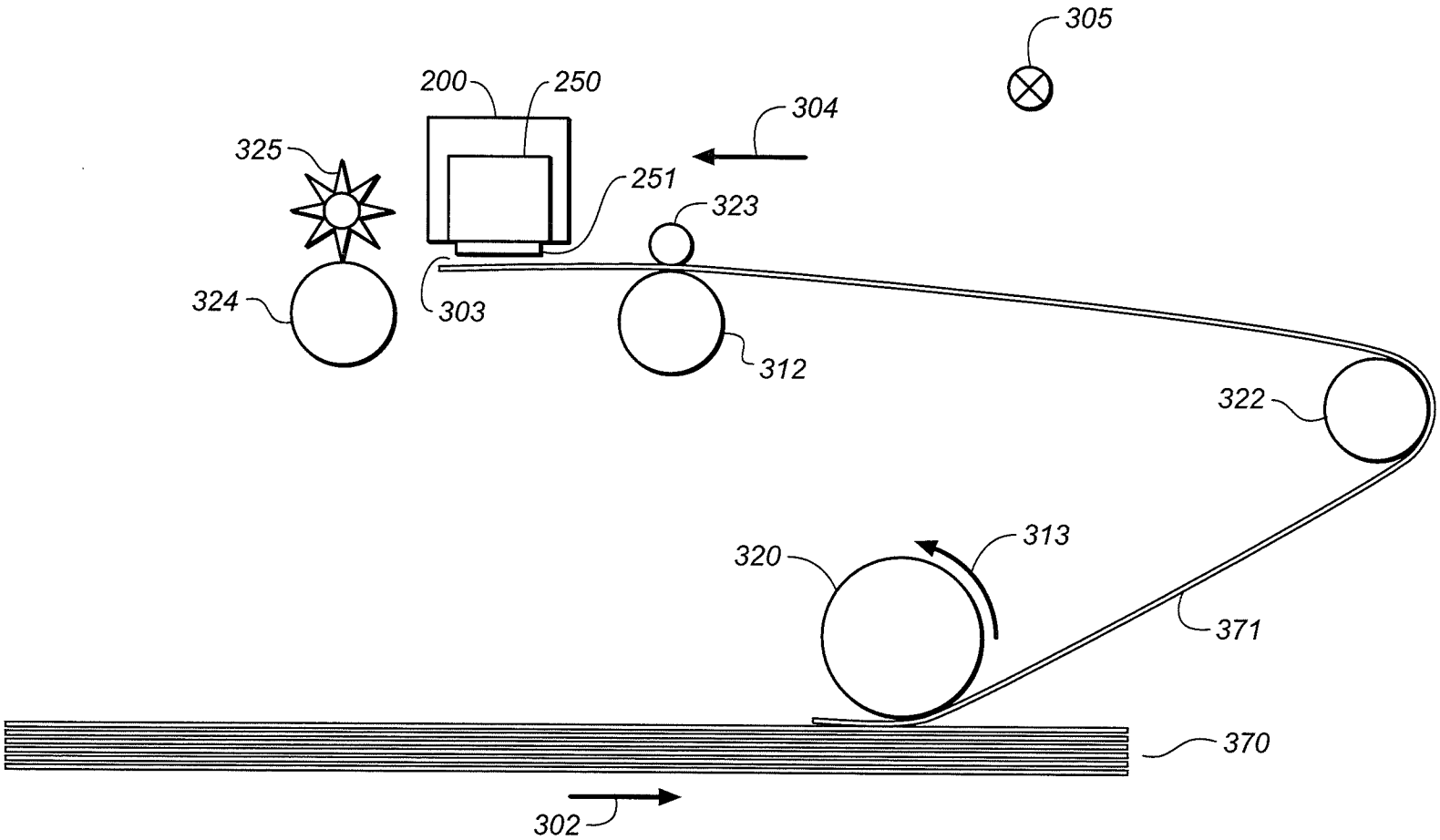
FIG. 4 is a schematic side view of a paper path in a carriage printer.

Carriage 200 is moved back and forth along carriage scan direction 305 (into and out of the plane of FIG. 4). In order to allow the nozzles to print the entire region of the paper, and then slow down the carriage to a stop prior to printing the next swath, the printhead die 251 typically travel beyond the side edges of sheet 371 of paper.

In order to provide good print quality, the printhead chassis 250 is positioned such that nozzle face 112 of printhead die 251 is somewhat close to sheet 371 of paper in printing region 303. Due to manufacturing defects or other asymmetries, for example, some jets may be angularly misdirected. By positioning nozzle face 112 of printhead die 251 nominally within about 1.5 mm of sheet 371 in printing zone 303, it is found that misdirected jets do not deviate too far from their intended positions so that the corresponding printed dots land in approximately the correct positions on sheet 371.

Because the nozzle face 112 of printhead die 251 is somewhat close to the sheet 371 of paper or other recording medium, in some undesirable circumstances, the sheet 371 can actually strike the nozzle face 112 or die edge 113. This can occur, for example, if the paper becomes folded or dog-eared, as schematically shown by folded edge 372 in FIG. 5. Paper strikes can also occur if multiple sheets are inadvertently fed at the same time, especially if a resulting paper jam causes the paper to fold in accordion fashion. In some instances, paper strikes result in ink smears on the printed page. However, an even more serious result can occur if the paper strike damages the nozzle face 112. Some types of nozzle faces are formed of fragile or brittle materials that can break or become distorted due to a paper strike such that future print quality is unacceptable and the printhead needs to be replaced.

Figure 5:
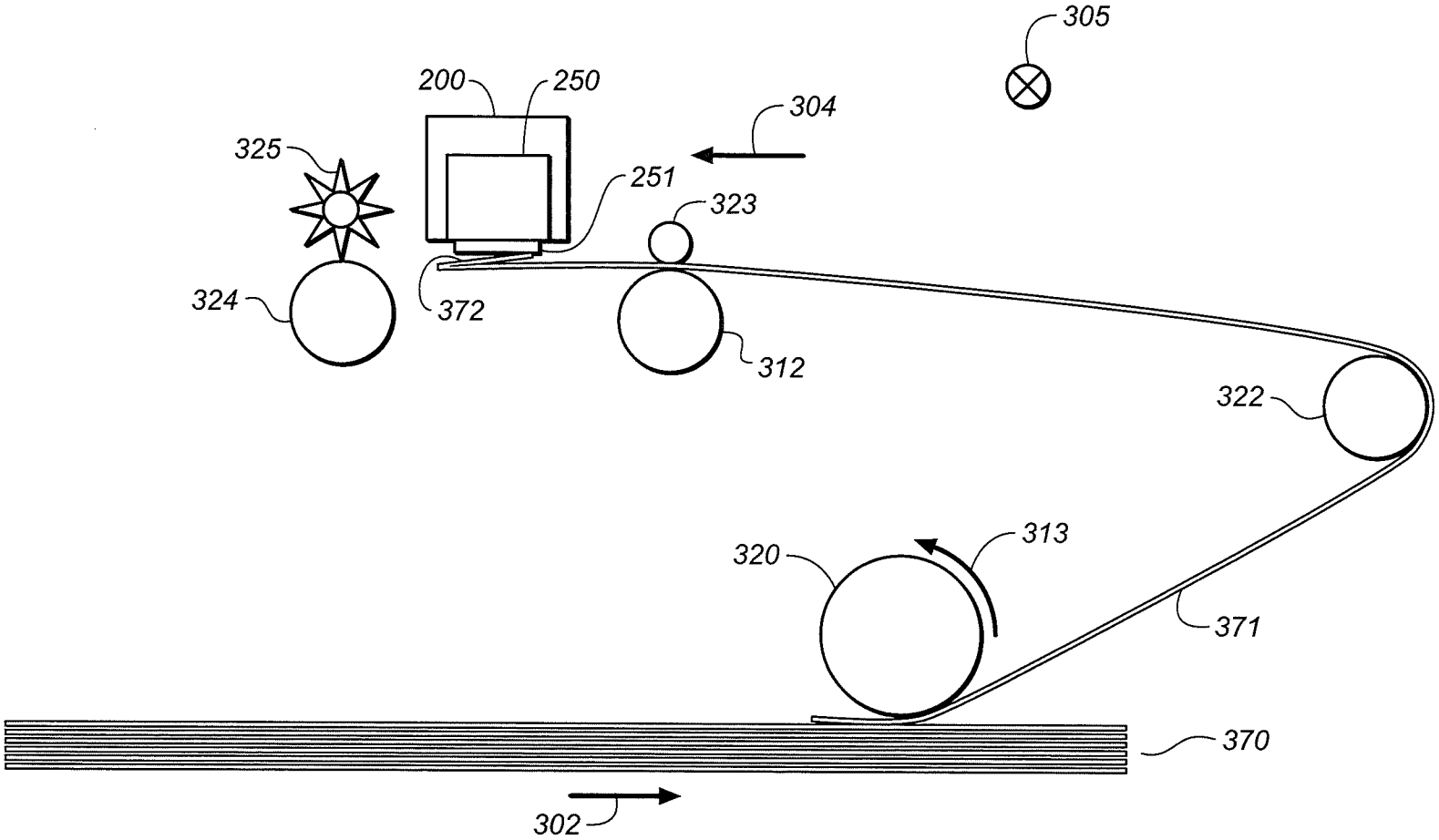
FIG. 5 is similar to FIG. 4, but for the case of a folded or dog-eared edge of paper striking the printhead face.
Figure 6:
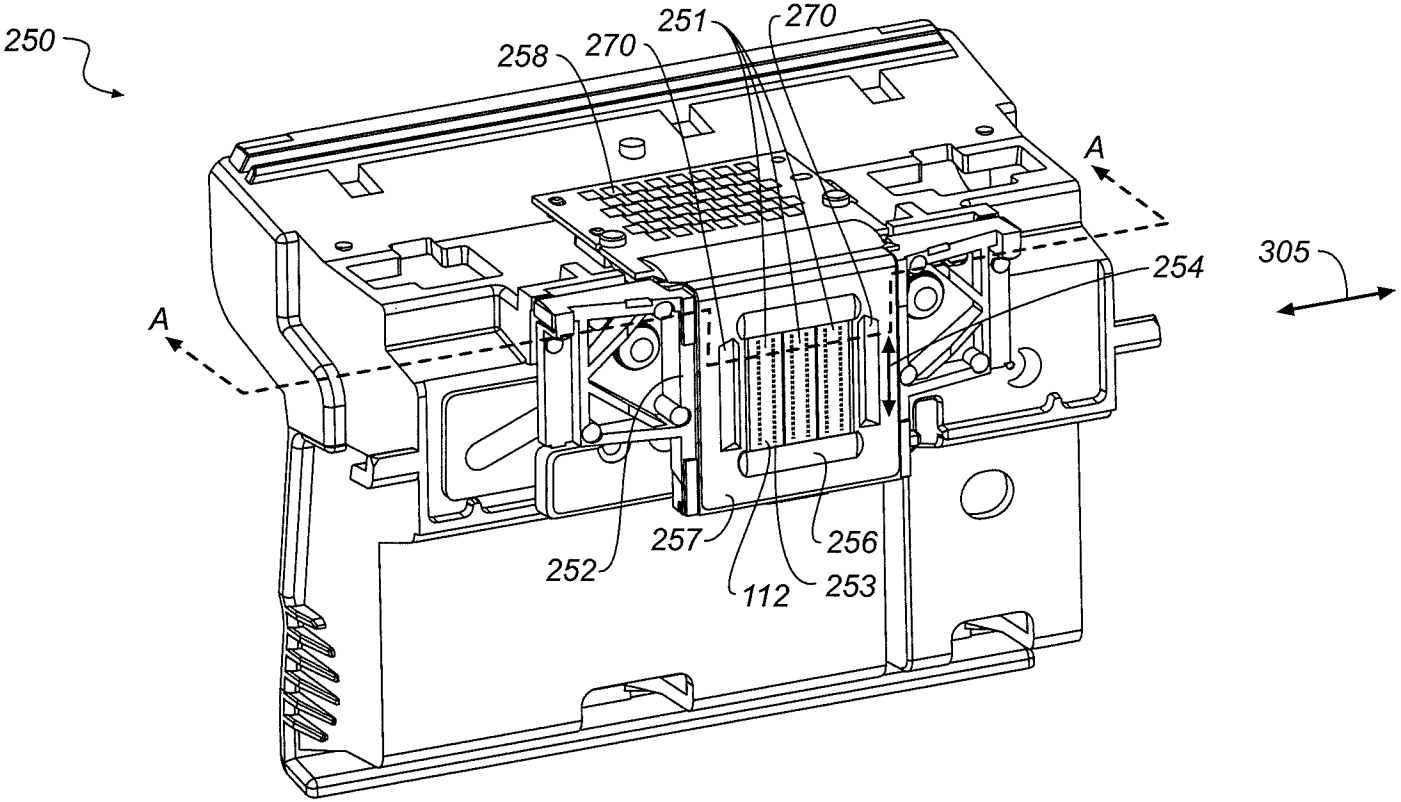
FIG. 6 (PRIOR ART)
FIG. 6 is a perspective view of a portion of a printhead chassis as in the prior art.

US Patent Application Publication 2010/0079542, incorporated by reference herein in its entirety, discloses one or more inclined surfaces that are positioned near the edge of the printhead die, such that if a dog-eared edge or other portion of paper is about to strike the nozzle face 112 or die edge 113, it first hits the inclined surface and is deflected away from the nozzle face and die edge, thereby protecting the nozzle plate from damage. FIG. 6 schematically shows a pair of inclined surfaces 270 provided on opposite sides of the three printhead die 251, as substantially disclosed in US Patent Application Publication 2010/0079542. FIG. 6 shows a printhead configuration substantially the same as shown in FIG. 3, except for the addition of the inclined surfaces 270. As the printhead chassis 250 is moved by carriage 200 along carriage scan direction 305, printhead die 251 are repeatedly moved past the side edges of sheet 371 of recording medium between printing of swaths. Sheet 371 of recording medium can include a dog-eared edge 372, for example, as shown in FIG. 5. When sheet 371 is advanced such that dog-eared edge 372 is aligned with printing zone 303, moving the carriage 200 in carriage scan direction 305 can cause dog-eared edge 372 to strike the printhead in the region of the printhead die 251. If, as in FIG. 3, there are no inclined surfaces protecting printhead die 251, the dog-eared edge 372 of recording medium can strike the face of nozzle plate 112 or at its edge 113 (shown in FIG. 1) where the nozzle plate 112 adjoins the die substrate 111. If nozzle plate 112 is made of a fragile or brittle material, or if the bond between nozzle plate 112 and die substrate 111 is sufficiently weak, paper strikes in either location can cause catastrophic damage to die 251. What the inclined surfaces 270 do is to deflect dog-eared edges 372 or other portions of paper being too closely approached, so that the paper skates along the inclined surface 270 and clears the printhead die edge 113 and nozzle face 112. It has been found that, for properly designed inclined surfaces 270, even if the deflected paper subsequently rebounds in time to hit a nozzle face 112 as the carriage 200 moves past, the paper makes a soft bounce landing rather than a damaging hard impact. Because dog-eared edges 372 or other types of paper folds can occur at either opposite side of sheet 371 of recording medium, inclined surfaces 270 are provided on both opposite sides of the printhead die 251 in this example. As shown in FIG. 6, the inclined surface 270 is positioned near an edge 113 of the printhead die 251 such that this edge is substantially parallel to nozzle array direction 254. That is because this is the edge of the die 251 (at or near the edge of nozzle plate 112) that approaches the edge of the sheet 371 of recording medium as the carriage 200 is scanned in carriage scan direction 305. The "tallest" portion of inclined surface 270 is nearest this edge 113 of die 251 that is substantially parallel to nozzle array direction 254 and includes the nozzle plate edge. The inclined surface 270 decreases in height relative to the surface of mounting substrate 252 at positions farther away from this edge of die 251.

Figure 7:
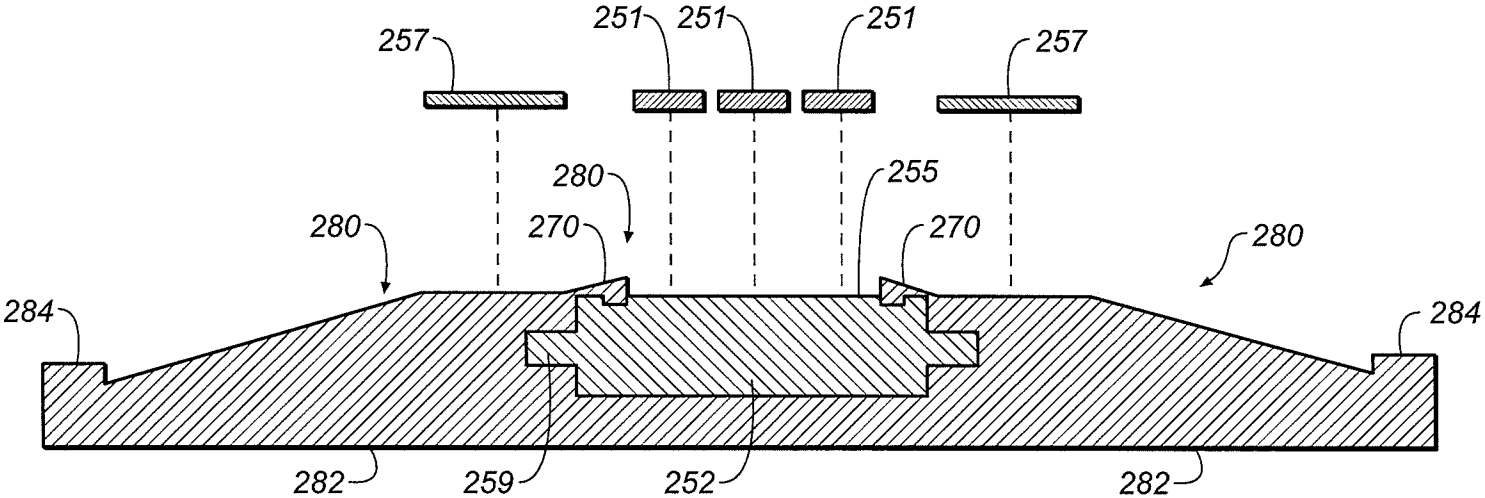
FIG. 7 (PRIOR ART)
FIG. 7 is a schematic cross-sectional exploded view of a portion of a mounting assembly with printhead die and flex circuit as in the prior art.

FIG. 7 schematically shows an exploded view of cross-section (A-A in FIG. 6) of a mounting assembly 280 having inclined surfaces 270, as disclosed in US Patent Application Publication 2010/0079542, in addition to printhead die 251 and flex circuit 257. Mounting assembly 280 is a part of printhead chassis 250 that can be made by insert molding, for example, as described in US Patent Application Publication 2008/0149024, and includes a mounting substrate 252 for printhead die 251. Mounting assembly 280 also includes a support region 282 that provides alignment features 284, as well as a support for flex circuit 257. In the insert molding process, die mounting substrate 252 (formed of ceramic, for example) can be placed in an injection molding tool and support region 282 is then formed (for example by molded plastic) around die mounting substrate 252. Die mounting substrate 252 includes a mounting surface 255 to which printhead die 251 are later attached during printhead assembly. Optionally, die mounting substrate 252 includes an outer rim 259 that helps secure the die mounting substrate 252 to the molded plastic of mounting assembly 280. Die mounting substrate 252 also can include ink feed slots (not shown in FIG. 7) through which ink can be provided to printhead die 251. Inclined surfaces 270 can be formed during the insert molding process by including corresponding features in the injection molding tool. In the example shown in FIG. 7, the inclined surfaces 270 are adjacent the edge of the ceramic mounting substrate 252 at mounting surface 255, although the inclined surfaces 270 overlie the outer rim 259 of mounting substrate 252 that is used to secure the mounting substrate 252 to the plastic portion of mounting assembly 280.

As seen in FIG. 6, encapsulant 256 can come close to inclined surface 270 near the outer corners of the outer printhead die 251 when encapsulant is subsequently deposited. For cases where inclined surfaces 270 are formed by injection molding as part of the insert molding process for mounting assembly 280 as described relative to FIG. 7 above, when the encapsulant is 256 is subsequently deposited, it can cross a boundary between dissimilar materials. In particular, mounting substrate 252 is typically formed of ceramic because of its small mismatch of thermal expansion relative to the silicon printhead die 251, its good thermal conductivity properties, its inertness relative to ink chemistries, and its capability of being formed with a flat surface. Support region 282, including inclined surfaces 270 are typically molded from a glass-filled plastic that is chosen for low cost, moldability, compatibility with inks, and adhesion to ceramic. Although the glass filling provides a lower coefficient of thermal expansion of support region 282 and inclined surfaces 270 than would be the case for unfilled plastic, the coefficient of thermal expansion would still typically be around 20 ppm per degree C., which is somewhat larger than the approximately 6 ppm per degree C. coefficient of thermal expansion of the ceramic mounting substrate 252. During the assembly of printhead chassis 250, printhead die 251 are adhesively bonded to mounting surface 255 of mounting substrate 252. Although not explicitly shown in FIG. 7, flex circuit 257 may be adhesively bonded to surface 255 as well as a surface of support region 282 of mounting assembly 280. Flex circuit 257 serves as an electrical interconnect member to provide electrical signals to printhead die 251. Although flex circuit 257 may bridge across materials (ceramic mounting substrate 252 and plastic support region 282), its flexibility accommodates the thermal stresses that are generated. Electrical interconnections are provided between bond pads on the printhead die 251 and bond pads on flex circuit 257, typically by wire bonding. Encapsulant 256 is then deposited over these electrical interconnections. The material chosen for encapsulant 256 needs to be compatible with there being many wipe cycles of the wipers of maintenance station 330 (FIG. 3). Therefore encapsulant 256 tends to be hard, rigid, and compatible with inks. Ceramic mounting substrate 252 and plastic support region 282 of mounting assembly 280 are also rigid materials. Thus, if encapsulant 256 bridges across ceramic mounting substrate 252 and plastic support region 282, there are no flexible materials to accommodate thermal stresses due to differences in thermal expansion. In particular, as encapsulant 256 cools down from being cured at elevated temperature, support region 282 tends to shrink more rapidly than ceramic mounting substrate 252 and tends toward pulling away at the interface. If encapsulant 256 bridges this interface (or boundary) between mounting substrate 252 and support region 282, it can crack due to the thermal stresses. Subsequently, over time, ink can enter the crack and compromise the reliability of encapsulant 256.

Figure 8:
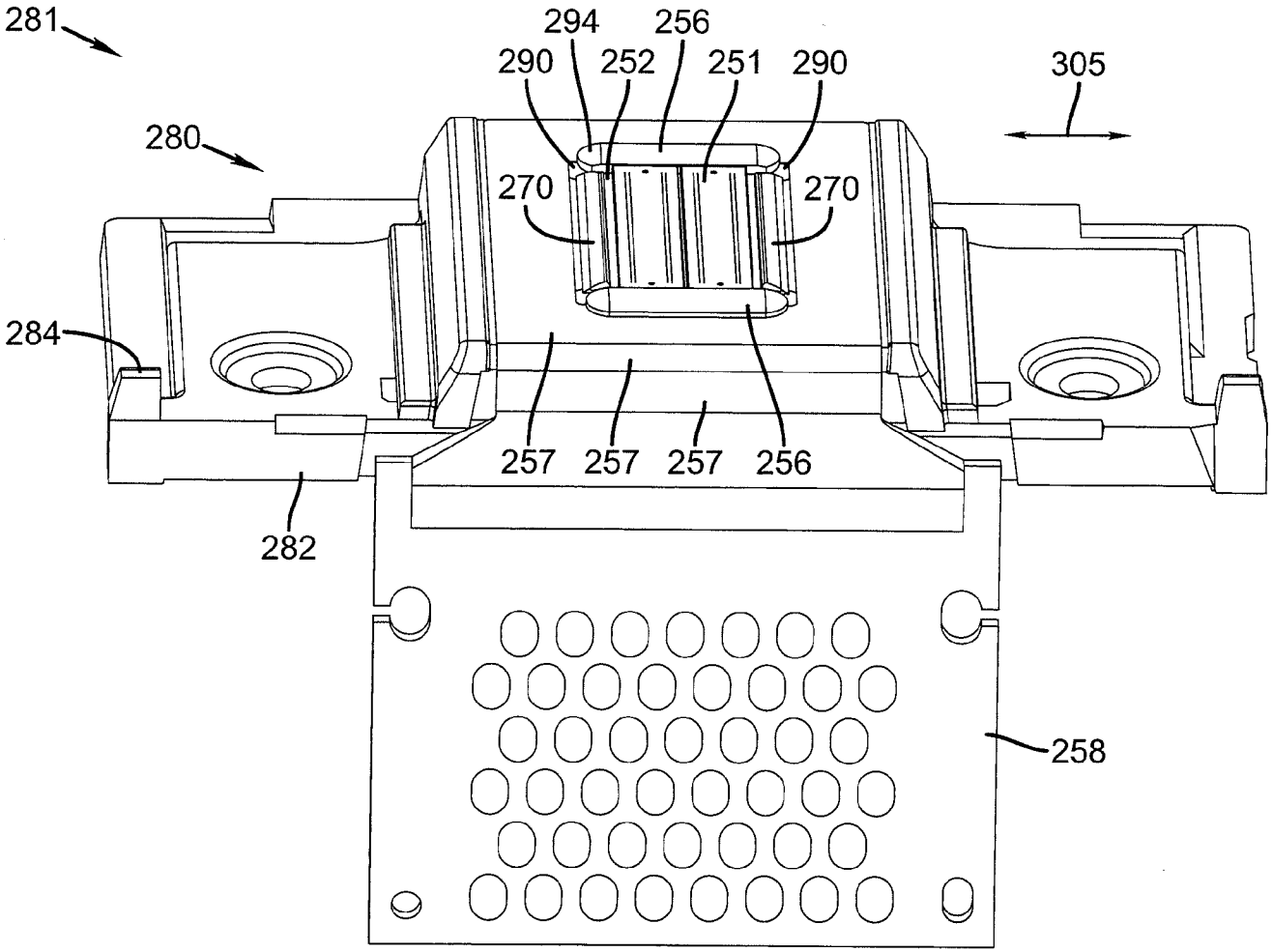
FIG. 8 is a perspective view of a portion of a printhead assembly according to an embodiment of the invention.
Figure 9:
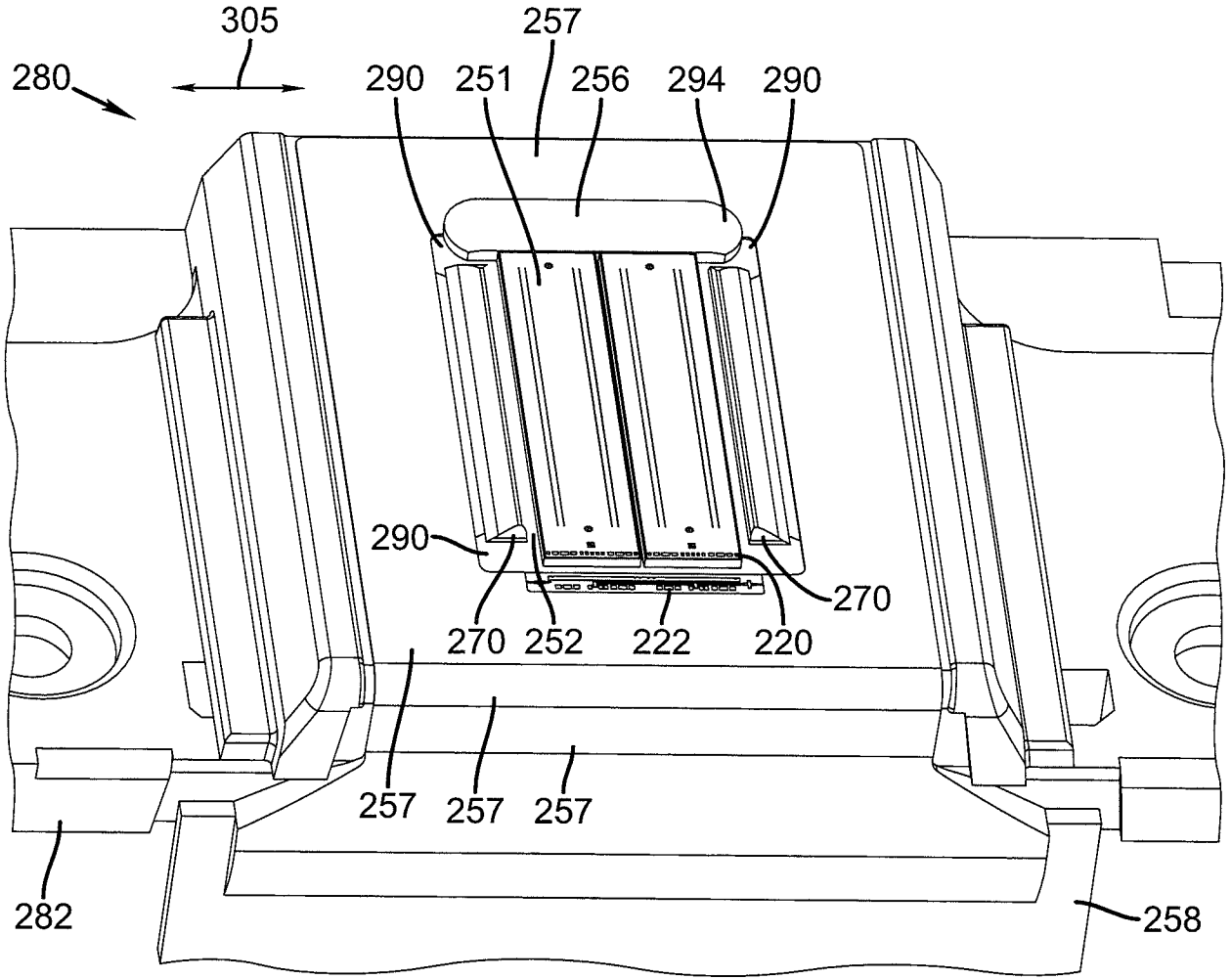
FIG. 9 is a close-up view of a portion of FIG. 8 with a region of encapsulant hidden to expose the bond pads of the printhead die.

An embodiment of the present invention is shown in FIGS. 8 and 9 for an example in which there are two printhead die 251 rather than the three that were shown in FIGS. 2, 6 and 7. FIG. 8 shows a portion of an intermediate printhead assembly 281 before it is affixed to the printhead chassis 250 (see FIGS. 2 and 6). As a reference, carriage scan direction 305 is indicated in relation to the orientation of intermediate printhead assembly 281 when printhead chassis 250 is installed in the printer. In order to keep end regions 294 of encapsulant 256 from bridging across the boundary between mounting substrate 252 and support region 282 of mounting assembly 280, extensions 290 are incorporated into mounting substrate 252 as is described in more detail below relative to FIGS. 12-14. FIG. 9 is a close-up view of the die mount region so that the extensions 290 can be seen with greater clarity. In addition one of the regions of encapsulant 256 has been hidden in order to show bond pads 220 disposed at an end of printhead die 251, as well as bond pads 222 on flex circuit 257.

Figure 10:
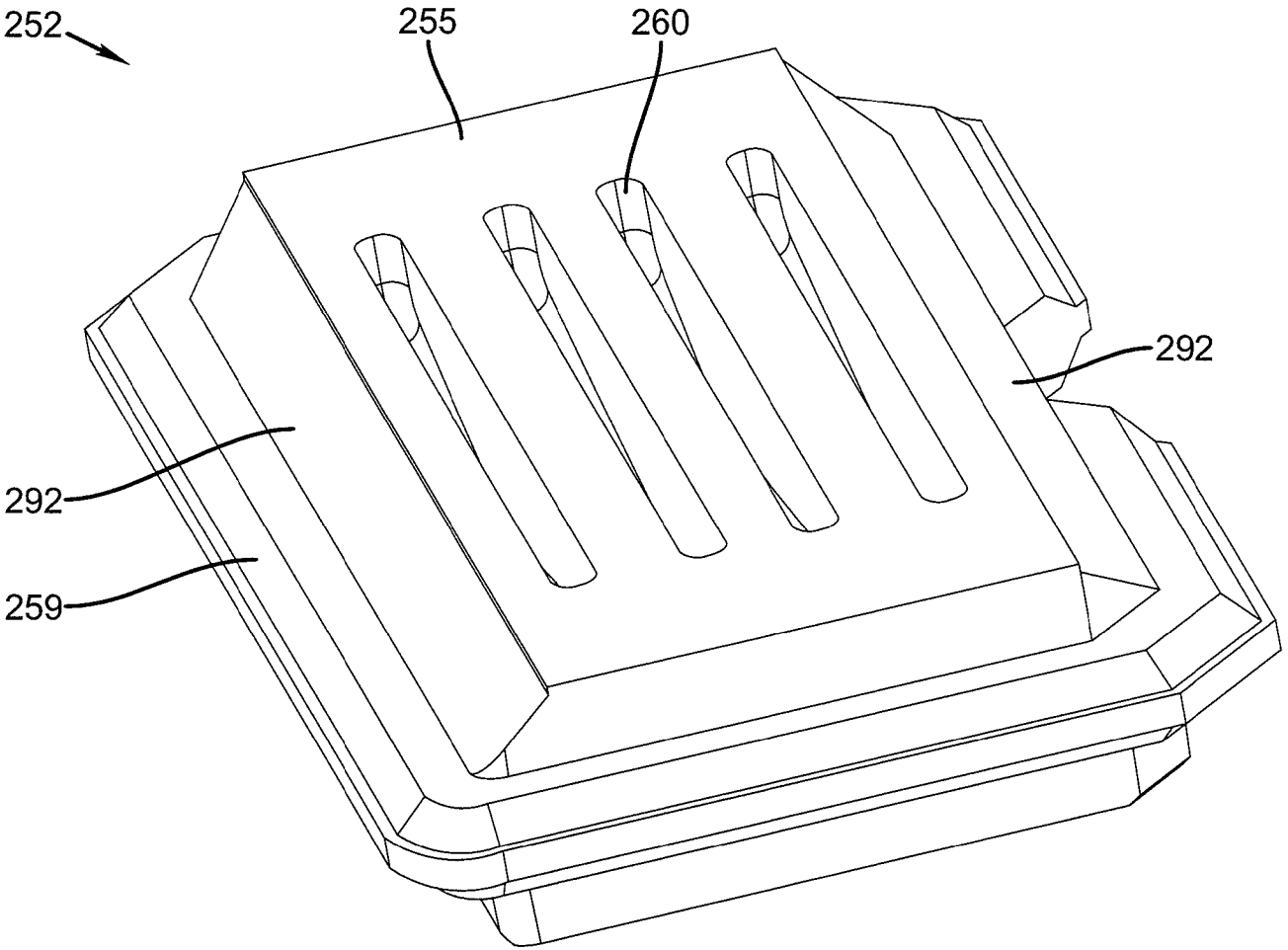
FIG. 10 is a perspective view of a mounting substrate not having extensions of the present invention for illustrating a problem addressed by the present invention.
Figure 11:
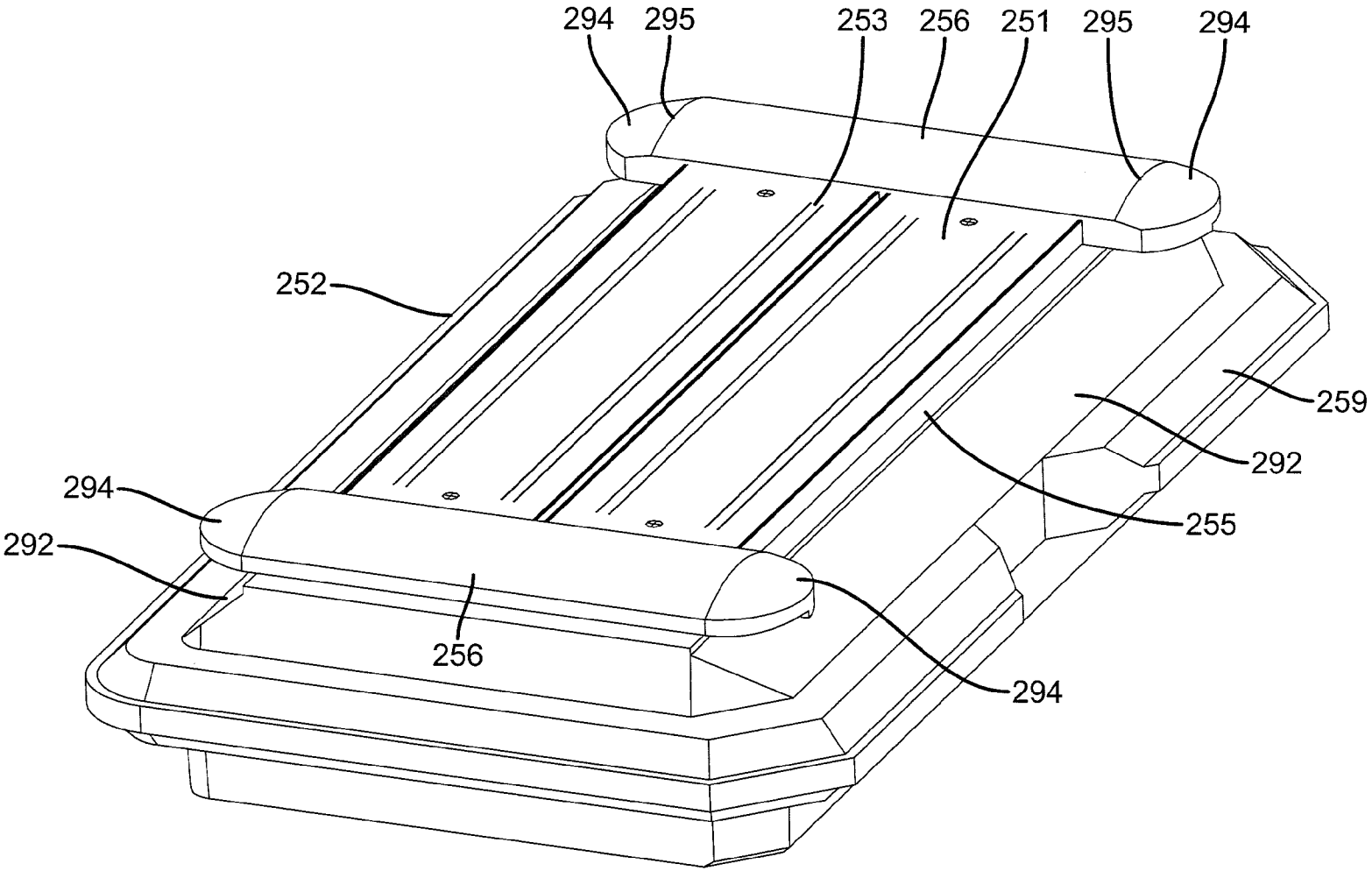
FIG. 11 is a perspective view of a portion of a printhead assembly having the mounting substrate of FIG. 10 and showing end regions of encapsulant beyond the surface of the mounting substrate for illustrating a problem addressed by the present invention.

One central aspect of the invention is the incorporation of extensions 290 in mounting substrate 252. In order to clarify the role of extensions 290, FIGS. 10 and 11 show a mounting substrate 252 not having the extensions 290 of the present invention in order to illustrate a problem that is addressed by the present invention. Mounting substrate 252 of FIG. 10 includes a mounting surface 255 for mounting two printhead die 251 (See FIG. 11). Four ink feed slots 260 are provided to supply ink to the two nozzle arrays 253 each on the two printhead die 251. An outer rim 259 helps secure mounting substrate to the plastic that will be injection molded around it to form mounting assembly 280. Sloped walls 292 adjoin mounting surface 255 and are recessed from it. Sloped walls 292 are provided to provide a base for molding inclined surfaces 270 (see FIG. 9). FIG. 11 shows two printhead die 251 mounted on mounting surface 255 of mounting substrate 252 and also shows encapsulant 256 with end regions 294. Other portions of the mounting assembly are hidden in FIG. 11 in order to indicate more clearly that end regions 294 of encapsulant 256 can overhang the sloped walls 292. In the mounting assembly, the injection molded plastic would flow into these overhang regions so that the encapsulant can inadvertently bridge across a boundary between the ceramic mounting substrate 252 and the extended part 282 of mounting assembly 280. This would result in stress regions 295 in encapsulant 256 that would be susceptible to cracking.

Figure 12:
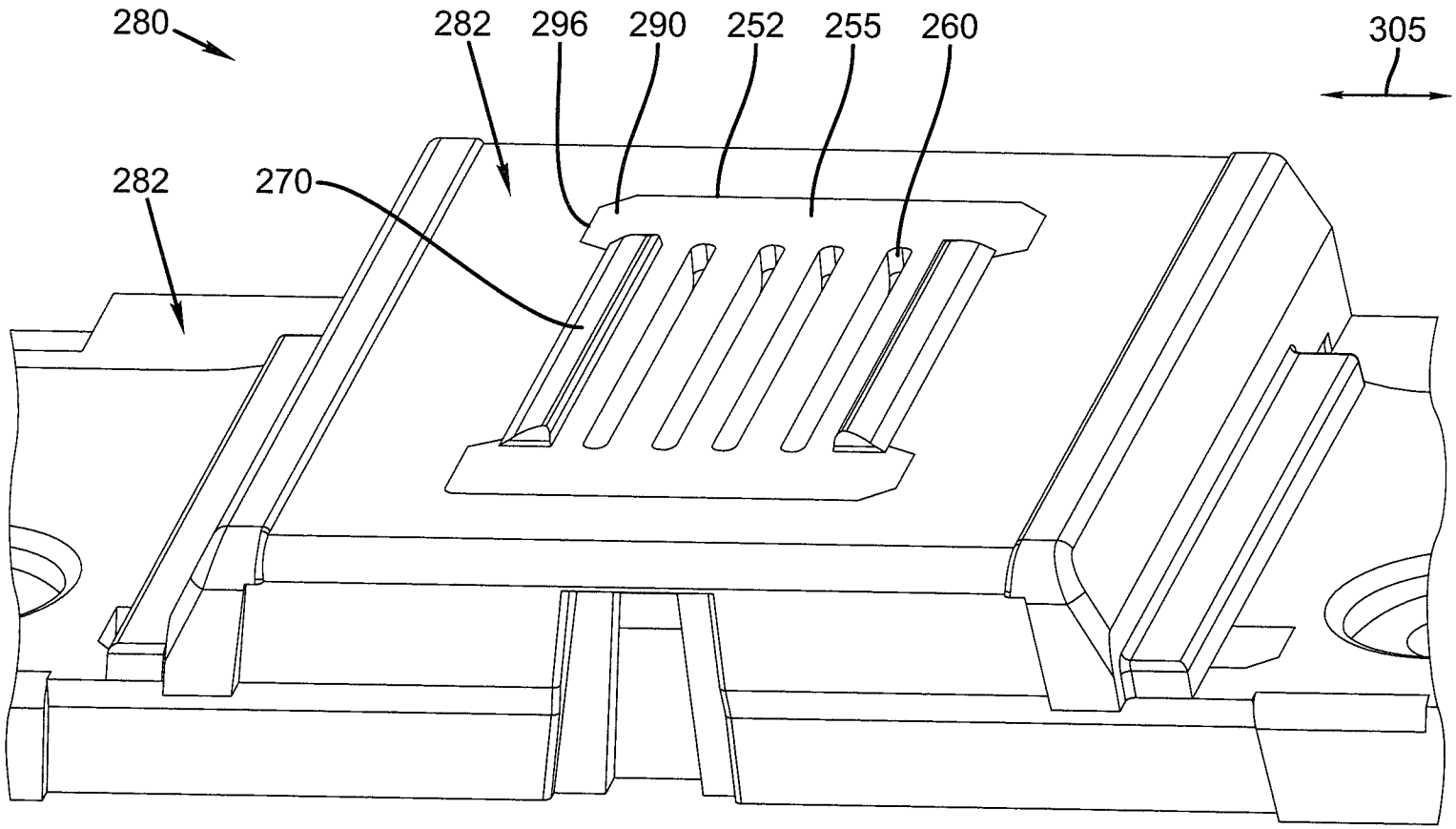
FIG. 12 is a perspective view of a mounting substrate according to an embodiment of the invention.
Figure 13:
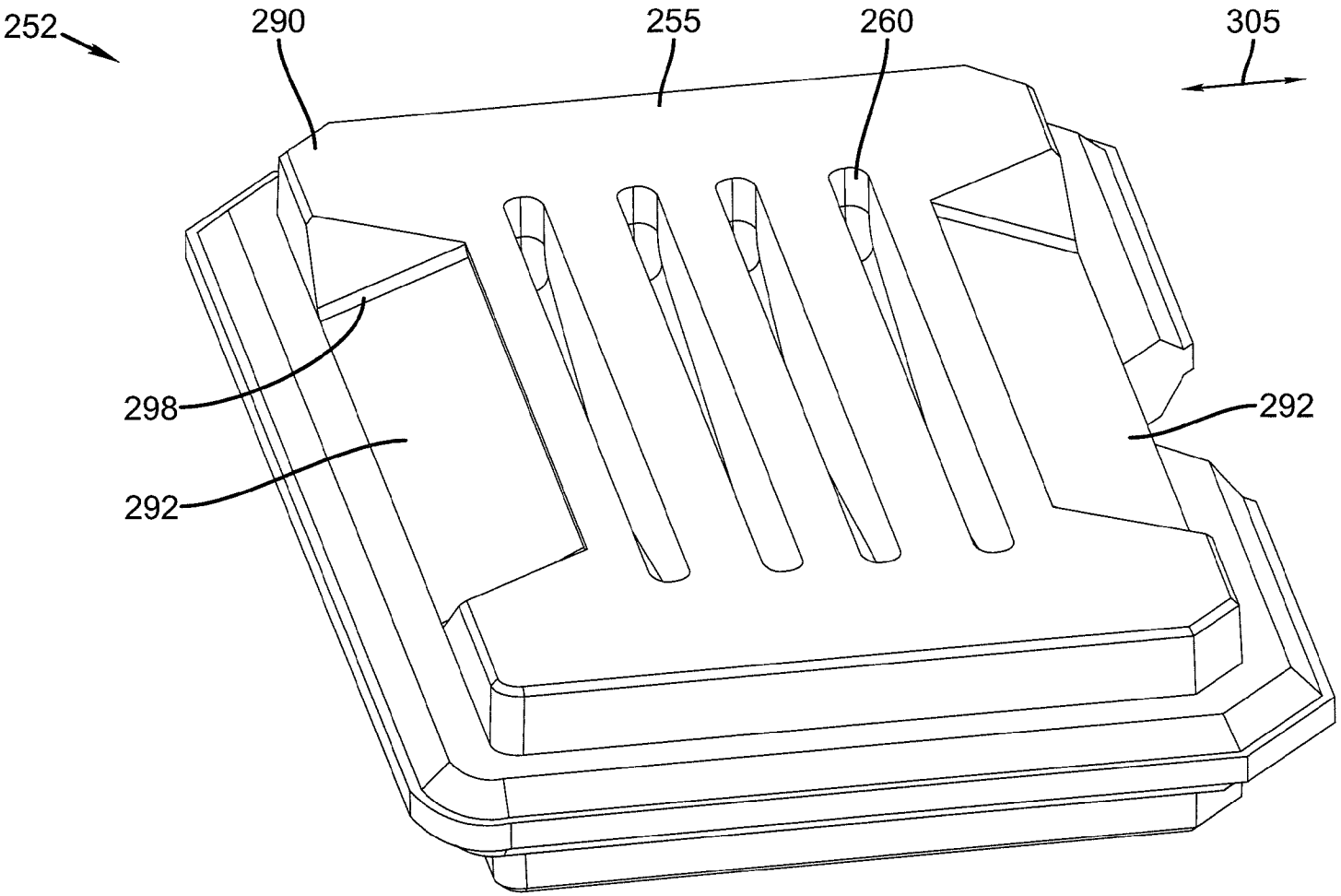
FIG. 13 is a perspective view of a mounting assembly including the mounting substrate of FIG. 12.
Figure 14:
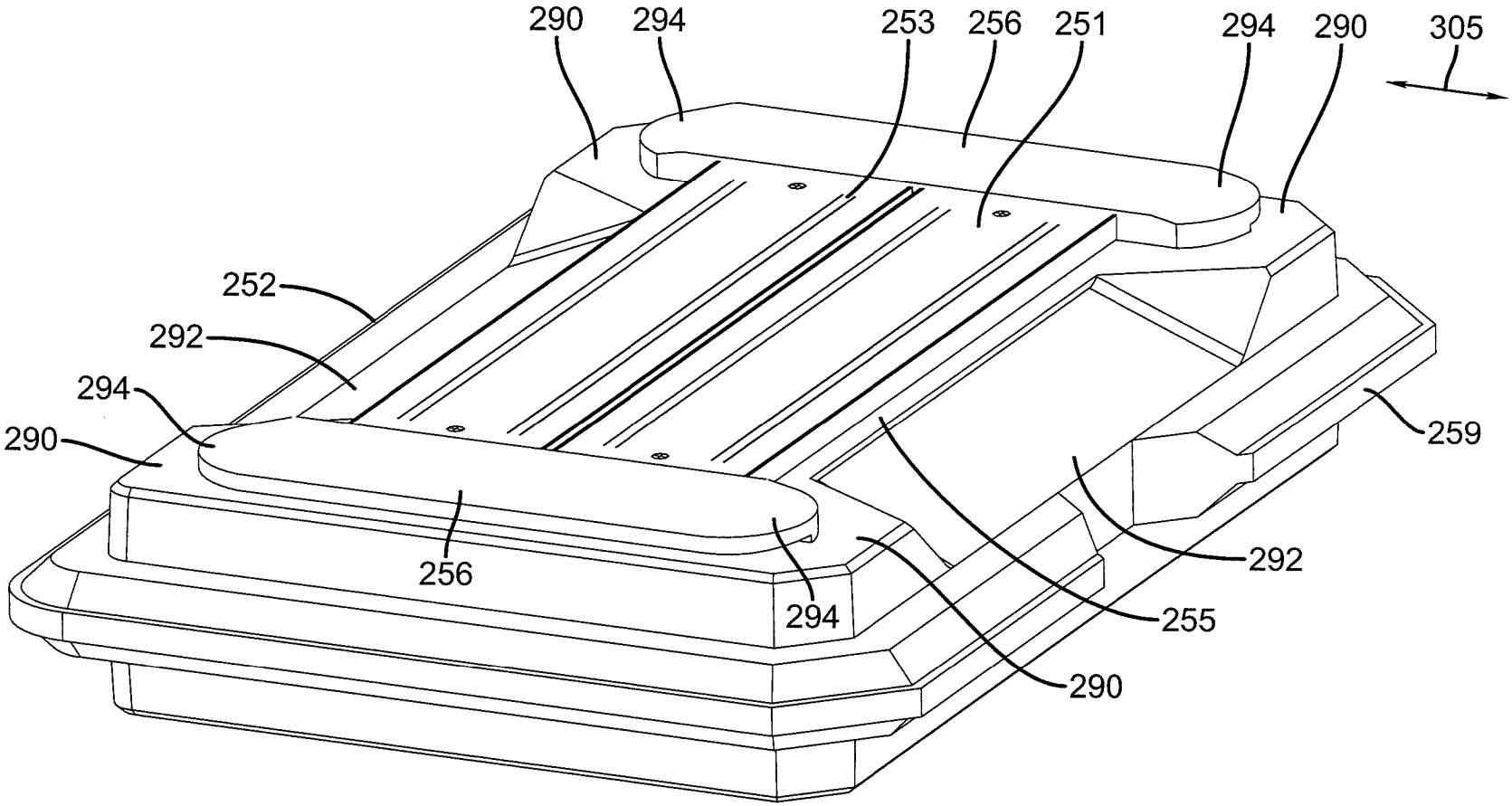
FIG. 14 is a perspective view of a portion of a printhead assembly having the mounting substrate of FIG. 12 and showing end regions of encapsulant supported by extensions of the mounting substrate.

By contrast, FIG. 12 shows a mounting assembly 280 according to an embodiment of the invention. In this example, mounting substrate 252 includes extensions 290 that are coplanar with the planar mounting surface 255. The boundary 296 where extension 290 is attached to support region 282 of mounting assembly 280 is disposed beyond where the end regions 294 of encapsulant 256 will be located (see FIG. 14), so that stress regions will not develop and the encapsulant 256 will not be susceptible to cracking. As seen in FIG. 13, mounting substrate 252 according to this embodiment of the present invention has sloped walls 292 that adjoin mounting surface 255 and are recessed from it. Sloped walls 292 provide a base for inclined surfaces 270 (so that a portion of support region 282 covers at least a portion of sloped walls 292, and the inclined surface 270 is raised relative to mounting surface 255). Extensions 290 extend past an end 298 of the walls 292. As seen in FIG. 14 (which hides portions of mounting assembly 280 in similar fashion to FIG. 11), end regions 294 of encapsulant 256 do not extend past extensions 290, so they do not bridge across a boundary of dissimilar materials. In other words, the encapsulant is attached to the extensions 290 of ceramic mounting substrate 252, but it is not attached to plastic support region 282 of mounting assembly 290 as may happen in the prior art due to tight manufacturing tolerance. The direction in which extensions 290 extend past end 298 of sloped wall 292 is parallel to the carriage scan direction 305. As shown in FIG. 9, inclined surface 270 is displaced from the edge of the printhead die 251 in a direction that is parallel to carriage scan direction 305.

The invention has been described in detail with particular reference to certain preferred embodiments thereof, but it will be understood that variations and modifications can be effected within the spirit and scope of the invention. In particular, the invention has been described in detail for inkjet printheads. More generally the invention can also be advantageous for other types of microelectronic devices having mounting assemblies formed of dissimilar materials, where a boundary between two materials having different coefficients of thermal expansion is located close to a region where encapsulation is to be deposited over electrical interconnections.

PARTS LIST

10 Inkjet printer system
12 Image data source
14 Controller
16 Electrical pulse source
18 First fluid source

19 Second fluid source
20 Recording medium
100 Ink jet printhead
110 Ink jet printhead die
111 Die substrate
112 Nozzle face
113 Edge of nozzle plate
120 First nozzle array
121 Nozzle in first nozzle array
122 Ink delivery pathway for first nozzle array
130 Second nozzle array
131 Nozzle in second nozzle array
132 Ink delivery pathway for second nozzle array
181 Droplet ejected from first nozzle array
182 Droplet ejected from second nozzle array
200 Carriage
220 Bond pads (printhead die)
222 Bond pads (flex circuit)
250 Printhead chassis
251 Printhead die
252 Mounting substrate
253 Nozzle array
254 Nozzle array direction
255 Mounting surface of mounting substrate
256 Encapsulant
257 Flex circuit
258 Connector board
259 Outer rim of mounting substrate
260 Ink feed slots
262 Multichamber ink supply
264 Single chamber ink supply
270 Inclined surface
280 Mounting assembly
281 Intermediate printhead assembly
282 Support region of mounting assembly
284 Alignment features
290 Extension
292 Wall
294 End region(s) (of encapsulant)
295 Stress region
296 Boundary
298 End (of wall)
300 Printer chassis
302 Paper load entry
303 Print region
304 Paper exit
305 Carriage scan direction
306 Right side of printer chassis
307 Left side of printer chassis
308 Front portion of printer chassis
309 Rear portion of printer chassis
310 Hole for paper advance motor drive gear
311 Feed roller gear
312 Feed roller
313 Forward rotation of feed roller
320 Pickup roller
322 Turn roller
323 Idler roller
324 Discharge roller
325 Star wheel
330 Maintenance station
370 Stack of media
371 Top sheet
372 Folded edge of paper
380 Carriage motor
382 Carriage rail
384 Belt
390 Printer electronics board
392 Cable connectors

The invention claimed is:

1. A mounting assembly for a microelectronic device, the mounting assembly comprising:

a first member formed of a first material having a first coefficient of thermal expansion, the first member including:

a) a mounting surface for the microelectronic device;

b) a sloped wall adjoins the mounting surface and is recessed from the mounting surface; and c) an extension of the mounting surface that extends beyond an end of the wall; and a second member formed of a plastic material having a second coefficient of thermal expansion that is larger than the first coefficient of thermal expansion, wherein a first portion of the second member is attached to the extension.

2. The mounting assembly of claim 1, wherein a second portion of the second member covers at least a portion of the wall.

3. The mounting assembly of claim 1, wherein the first material is ceramic.

4. The mounting assembly of claim 2, wherein a surface of the second portion of the second member is raised relative to the planar mounting surface.

5. A microelectronic device assembly comprising:

a microelectronic device including bond pads disposed at an end of the device;

a mounting assembly comprising:

a) a first member formed of a first material having a first coefficient of thermal expansion, the first member including:

i) a mounting surface for the microelectronic device;

ii) a sloped wall adjoins the mounting surface and is recessed from the mounting surface; and iii) an extension of the mounting surface that extends beyond an end of the sloped wall;

b) a second member formed of an injected molded plastic material having a second coefficient of thermal expansion that is larger than the first coefficient of thermal expansion, wherein a first portion of the second member is attached to the extension, and wherein a second portion of the second member covers at least a portion of the sloped wall;

c) an electrical interconnect member;

d) electrical interconnections between the bond pads of the microelectronic device and the electrical interconnect member; and e) an encapsulant covering the electrical interconnections, wherein the encapsulant is fixedly attached to the extension of the first member, and wherein the encapsulant is not fixedly attached to the second member.

6. An inkjet printhead assembly comprising:

an inkjet printhead die including bond pads disposed at an end of the die;

a mounting assembly comprising:

a) a first member formed of a first material having a first coefficient of thermal expansion, the first member including:

i) a mounting surface for the inkjet printhead die;

ii) a sloped wall adjoins the mounting surface and is recessed from the mounting surface; and iii) an extension of the mounting surface that extends beyond an end of the sloped wall;

b) a second member formed of an injected molded plastic material having a second coefficient of thermal expansion that is larger than the first coefficient of thermal expansion, wherein a first portion of the second member is attached to the extension;

c) an electrical interconnect member;

d) electrical interconnections between the bond pads of the inkjet printhead die and the electrical interconnect member; and e) an encapsulant covering the electrical interconnections, wherein the encapsulant is fixedly attached to the extension of the first member, and wherein the encapsulant is not fixedly attached to the second member.

7. The inkjet printhead assembly of claim 6, wherein a second portion of the second member covers the sloped wall.

8. The inkjet printhead assembly of claim 6, wherein the first material is ceramic.

9. The inkjet printhead assembly of claim 7, wherein a surface of the second portion of the second member is raised relative to the mounting surface.

10. The inkjet printhead assembly of claim 9, wherein the surface of the second portion of the second member is inclined relative to the mounting surface.

11. The inkjet printhead assembly of claim 10, wherein the surface of the second portion of the second member is proximate an edge of the inkjet printhead die.

12. An inkjet printing apparatus comprising:

a carriage that travels along a carriage scan direction; and a printhead assembly positioned on the carriage, the printhead assembly comprising:

an inkjet printhead die including bond pads disposed at an end of the die;

a mounting assembly comprising:

a) a first member formed of a first material having a first coefficient of thermal expansion, the first member including:

i) a mounting surface for the inkjet printhead die;

ii) a sloped wall adjoins the mounting surface and is recessed from the mounting surface; and iii) an extension of the mounting surface that extends beyond an end of the sloped wall;

b) a second member formed of an injected molded plastic material having a second coefficient of thermal expansion that is larger than the first coefficient of thermal expansion, wherein a first portion of the second member is attached to the extension;

c) an electrical interconnect member;

d) electrical interconnections between the bond pads of the inkjet printhead die and the electrical interconnect member; and e) an encapsulant covering the electrical interconnections, wherein the encapsulant is fixedly attached to the extension of the first member, and wherein the encapsulant is not fixedly attached to the second member.

13. The inkjet printing apparatus of claim 12, wherein a second portion of the second member covers the sloped wall.

14. The inkjet printing apparatus of claim 13, wherein a direction that the extension of the first member extends past an end of the sloped wall is parallel to the carriage scan direction.

15. The inkjet printing apparatus of claim 12, wherein the first material is ceramic.

16. The inkjet printing apparatus of claim 13, wherein a surface of the second portion of the second member is raised relative to the planar mounting surface.

17. The inkjet printing apparatus of claim 16, wherein the surface of the second portion of the second member is inclined relative to the planar mounting surface.

18. The inkjet printing apparatus of claim 17, wherein the surface of the second portion of the second member is proximate an edge of the inkjet printhead die.

19. The inkjet printing apparatus of claim 18, wherein the surface of the second portion of the second member is displaced from the edge of the inkjet printhead die in a direction that is parallel to the carriage scan direction.

* * * * *